US009211020B2

(12) United States Patent
Hodge

(10) Patent No.: US 9,211,020 B2
(45) Date of Patent: Dec. 15, 2015

(54) INTERLOCKING COMPARTMENTS FOR DISPLAY UNIT

(75) Inventor: Gary Hodge, Rutherfordton, NC (US)

(73) Assignee: PPG Architectural Finishes, Inc., Pittsburgh, PA (US)

( * ) Notice: Subject to any disclaimer, the term of this patent is extended or adjusted under 35 U.S.C. 154(b) by 204 days.

(21) Appl. No.: 12/754,992

(22) Filed: Apr. 6, 2010

(65) Prior Publication Data

US 2010/0314345 A1 Dec. 16, 2010

Related U.S. Application Data

(60) Provisional application No. 61/185,848, filed on Jun. 10, 2009.

(51) Int. Cl.

| | |
|---|---|
| ***A47F 5/08*** | (2006.01) |
| ***A47F 1/04*** | (2006.01) |
| ***A47F 3/14*** | (2006.01) |
| ***A47F 5/00*** | (2006.01) |
| *A47B 87/02* | (2006.01) |

(52) U.S. Cl.

CPC ..... *A47F 3/14* (2013.01); *A47F 5/0025* (2013.01); *A47B 87/0269* (2013.01)

(58) Field of Classification Search

CPC ..... A47F 5/0025; A47B 87/0269; B65D 21/0235; B65D 21/0209

USPC ..... 211/59.2, 52, 55, 49.1, 188, 194, 211/126.12, 128.1; 312/108

See application file for complete search history.

(56) References Cited

U.S. PATENT DOCUMENTS

| | | | | |
|---|---|---|---|---|
| 2,119,788 | A * | 6/1938 | Kieffer et al. | 108/99 |
| 2,320,388 | A | 6/1943 | Shaw | |
| 2,801,753 | A | 8/1957 | Shaw | |
| 2,915,162 | A | 12/1959 | Umstead | |

(Continued)

FOREIGN PATENT DOCUMENTS

| | | | | |
|---|---|---|---|---|
| EP | 0 252 681 A2 | 1/1988 | | |
| FR | 2 867 369 | 9/2005 | | |
| GB | 2270067 A * | 3/1994 | | B65D 21/02 |

OTHER PUBLICATIONS

European Search Report for Application No. EP 09 16 5043.2 dated Dec. 23, 2009.

(Continued)

*Primary Examiner* — Joshua Rodden
*Assistant Examiner* — Kimberley S Wright
(74) *Attorney, Agent, or Firm* — Alan G. Towner

(57) ABSTRACT

The invention relates to interlocking compartments which are assembled to form a display unit. In some embodiments, the interlocking compartments include a first compartment and a second compartment having a top surface, a bottom surface and a rear surface. The bottom surface of the second compartment includes a tongue and the top surface of the first compartment includes a groove for receiving the tongue. The rear surface of the second compartment includes a projection and the rear surface of the first compartment and the top surface of the first compartment form a corner having an indentation for receiving the projection. In some embodiments, the length of the bottom surface of the first compartment is greater than the length of the bottom surface of the second compartment, and the length of the bottom surface of the second compartment is greater than the length of the bottom surface of the third compartment.

21 Claims, 7 Drawing Sheets

(56) References Cited

U.S. PATENT DOCUMENTS

| | | | | | |
|---|---|---|---|---|---|
| 2,926,978 | A | * | 3/1960 | Mitchell | 312/108 |
| 2,988,412 | A | * | 6/1961 | Vannice | 312/111 |
| 3,103,278 | A | * | 9/1963 | Kuzma et al. | 206/433 |
| 3,224,822 | A | | 12/1965 | Kirby | |
| 3,420,402 | A | * | 1/1969 | Frater et al. | 206/507 |
| 3,544,021 | A | * | 12/1970 | Morgan et al. | 220/7 |
| 3,606,025 | A | * | 9/1971 | Wilson | 211/126.9 |
| 3,704,791 | A | * | 12/1972 | Young, Jr. | 211/126.9 |
| 3,713,579 | A | * | 1/1973 | Chaffers | 206/509 |
| 3,834,324 | A | * | 9/1974 | Lang | 108/91 |
| 3,836,008 | A | | 9/1974 | Mraz | |
| 3,838,840 | A | * | 10/1974 | Urban | 248/146 |
| 3,935,991 | A | * | 2/1976 | Crane | 206/509 |
| 3,941,247 | A | * | 3/1976 | Cripe | 206/511 |
| 4,015,713 | A | * | 4/1977 | Clipson et al. | 206/509 |
| 4,079,836 | A | * | 3/1978 | Von Stein et al. | 206/513 |
| 4,120,444 | A | * | 10/1978 | Gray | 229/198.1 |
| 4,146,139 | A | | 3/1979 | von Stein et al. | |
| 4,155,452 | A | * | 5/1979 | Wettermann et al. | 206/512 |
| 4,228,903 | A | | 10/1980 | Eckert | |
| 4,232,916 | A | * | 11/1980 | Correia | 312/107 |
| 4,428,487 | A | * | 1/1984 | Hepp | 211/126.12 |
| 4,435,026 | A | | 3/1984 | Johnson | |
| 5,039,002 | A | * | 8/1991 | Spamer | 206/459.5 |
| 5,190,156 | A | * | 3/1993 | Conaway et al. | 206/509 |
| 5,228,590 | A | | 7/1993 | Blasko et al. | |
| 5,287,980 | A | * | 2/1994 | Saltz | 220/4.27 |
| 5,372,257 | A | * | 12/1994 | Beauchamp et al. | 206/504 |
| 5,752,602 | A | * | 5/1998 | Ackermann et al. | 206/507 |
| 5,758,783 | A | * | 6/1998 | Maglione | 211/126.2 |
| 5,788,117 | A | | 8/1998 | Zimmanck | |
| 5,826,732 | A | * | 10/1998 | Ragsdale | 211/149 |
| 5,865,324 | A | | 2/1999 | Jay et al. | |
| 5,899,345 | A | * | 5/1999 | Fuller et al. | 211/132.1 |
| 5,984,120 | A | | 11/1999 | Johnske | |
| 6,536,609 | B2 | | 3/2003 | Lake | |
| 6,786,341 | B2 | | 9/2004 | Stinnett et al. | |
| 7,118,023 | B2 | * | 10/2006 | Holdsworth | 229/164 |
| 7,350,648 | B2 | * | 4/2008 | Gerstner et al. | 211/87.01 |
| 7,637,372 | B2 | * | 12/2009 | Keel et al. | 206/509 |
| 8,056,723 | B2 | * | 11/2011 | Cavalcante | 206/511 |
| 8,342,329 | B2 | * | 1/2013 | Kobilarcik et al. | 206/509 |
| 2007/0069491 | A1 | * | 3/2007 | Ferraro et al. | 280/79.11 |
| 2007/0075043 | A1 | | 4/2007 | Riogonzalez et al. | |
| 2007/0131632 | A1 | | 6/2007 | Brown et al. | |
| 2008/0197089 | A1 | | 8/2008 | Chang | |
| 2009/0178989 | A1 | * | 7/2009 | Accuardi | 211/126.7 |
| 2013/0026057 | A1 | * | 1/2013 | Shapiro | 206/459.5 |

OTHER PUBLICATIONS

European Search Report for Application EP 09 16 5042.4 dated Dec. 23, 2009.

* cited by examiner

INTERLOCKING COMPARTMENTS FOR DISPLAY UNIT

BACKGROUND OF THE INVENTION

The present invention relates to interlocking compartments for display units.

SUMMARY OF THE INVENTION

The present invention provides interlocking compartments which can be assembled to form a display unit. For non-limiting example, the display unit may display paint and paint related products, such as paint chips and paint testers. However, the interlocking compartments can be assembled to form a display unit which displays any type of material. For non-limiting example, the interlocking compartments of the invention can be assembled to form shelving for storing or displaying any type of merchandise or boxed items.

DETAILED DESCRIPTION OF THE INVENTION

As used in the afore-discussed embodiments and other embodiments of the disclosure and claims described herein, the following terms generally have the meaning as indicated, but these meanings are not meant to limit the scope of the invention if the benefit of the invention is achieved by inferring a broader meaning to the following terms.

Also herein, "a," "an," "the", "at least one", and "one or more" are used interchangeably.

Also herein, the term "comprises" and variations thereof do not have a limiting meaning where these terms appear in the description and claims.

The terms "for example", "without limitation" and the like, as well as the exemplary compounds, ranges, parameters and the like disclosed throughout the application and claims are intended to identify embodiments of the invention in a non-limiting manner. Other compounds, ranges, parameters and the like can be employed by those skilled in the art without departing from the spirit and scope of the invention.

Figure 1:
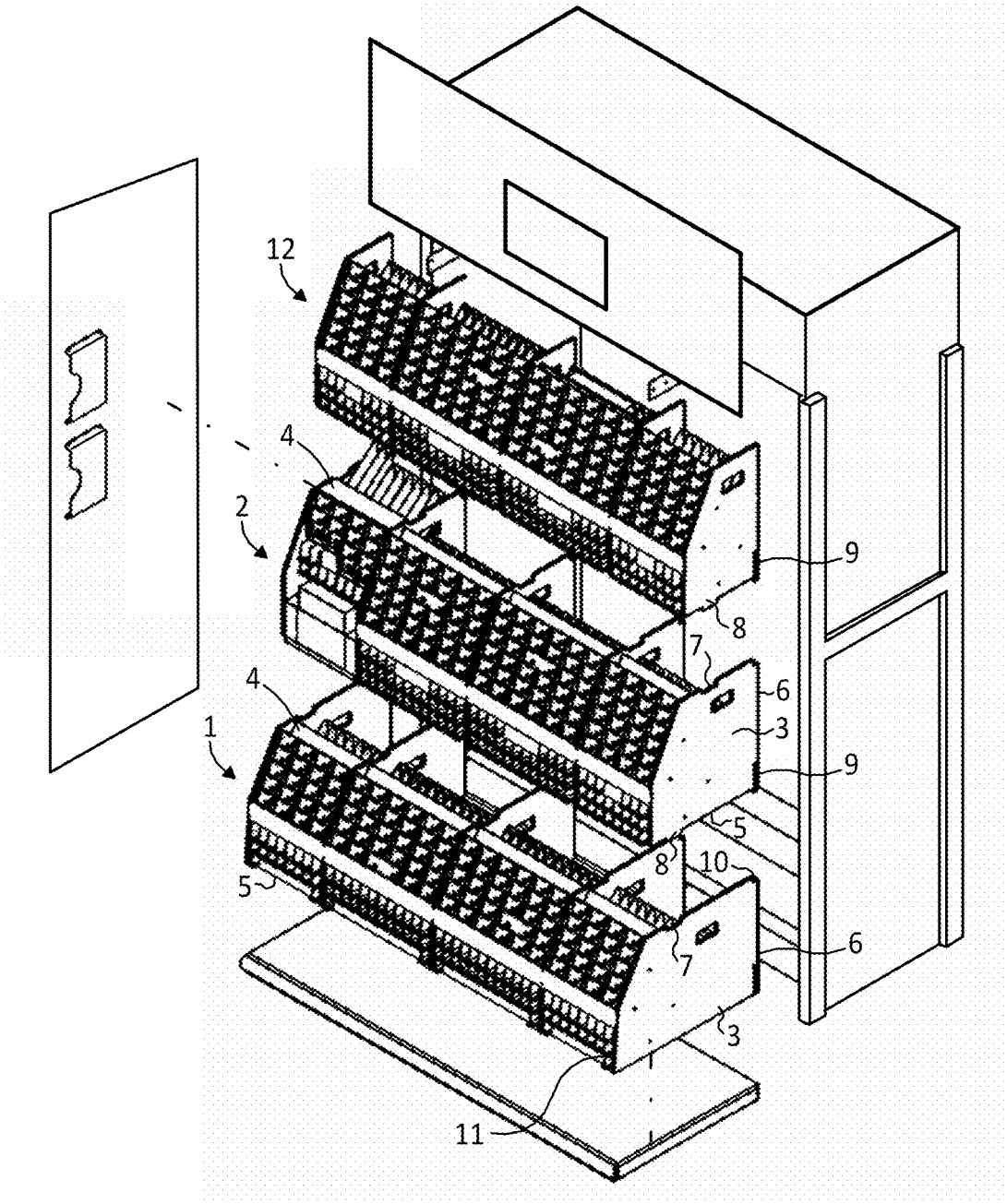
FIG. 1 illustrates an exploded perspective view of three rows of compartments prior to connection to each other.

As illustrated in FIG. 1 for example, a display unit is composed of a plurality of interlocking compartments. First compartment 1 and second compartment 2 each have a vertical sidewall 3 comprising a top surface 4, a bottom surface 5 and a rear surface 6. In some embodiments, the top surface

4 of the first compartment 1 comprises a groove 7 for receiving a tongue 8 of the bottom surface 5 of the second compartment 2. The tongue 8 and groove 7 mate during assembly to securely attach the compartments 1,2. The tongue 8 and groove 7 facilitate assembly, which minimizes the need for an assembler to measure or otherwise align the compartments 1,2 in a complicated manner.

Figure 2A:
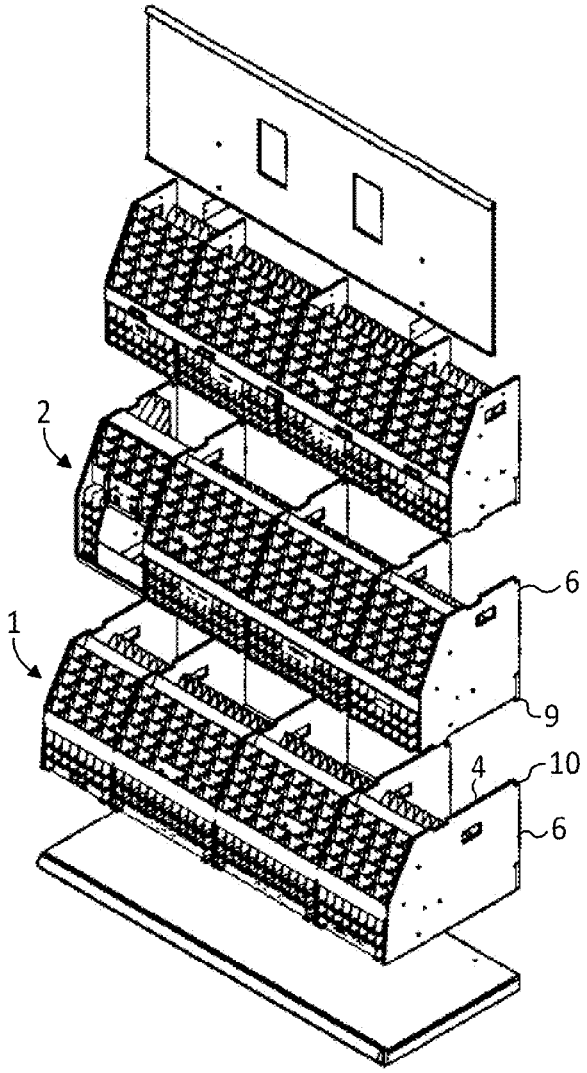
FIG. 2A illustrates a perspective view of three rows of compartments prior to connection to each other.
Figure 2B:
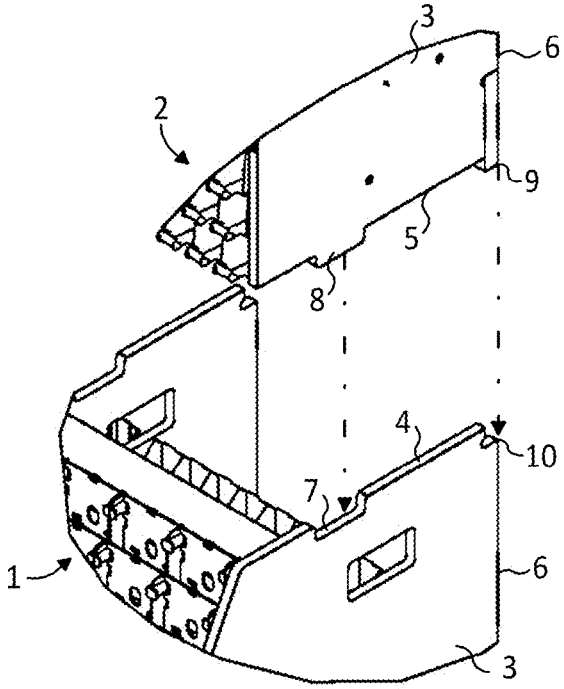
FIG. 2B illustrates a local perspective view two compartments prior to connection to each other.

FIGS. 1, 2A and 2B, for example, illustrate the rear surface 6 of the second compartment 2 which has a projection 9. The rear surface 6 of first compartment 1 and the top surface 4 of the first compartment 1 form a corner having an indentation 10 for receiving projection 9 during assembly. The indentation 10 and projection 9 mate to securely attach the compartments 1,2 and minimize the need for an assembler to measure or otherwise align the compartments 1,2 in a complicated manner.

Figure 3:
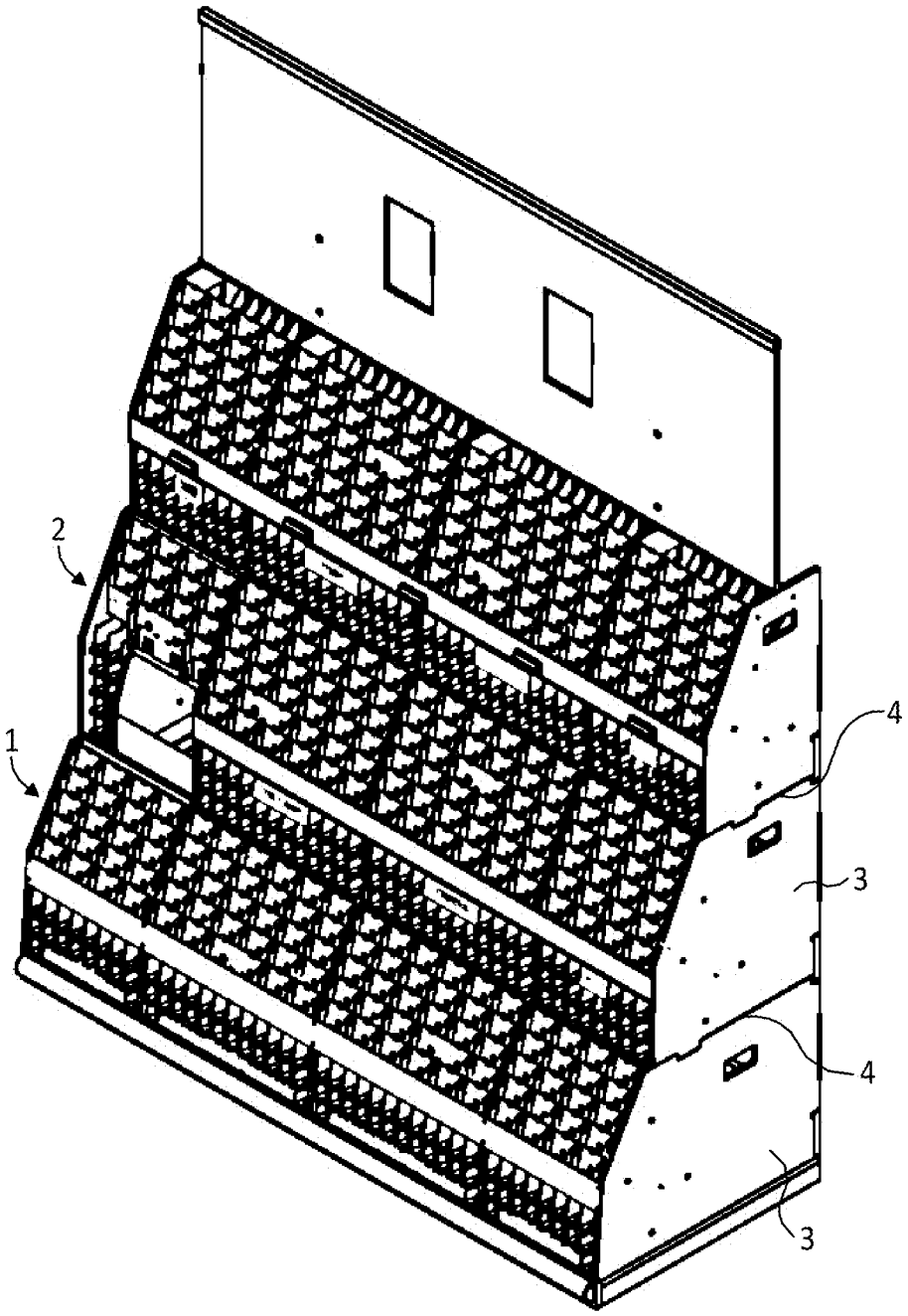
FIG. 3 illustrates a perspective view of three rows of assembled compartments.
Figure 4A:
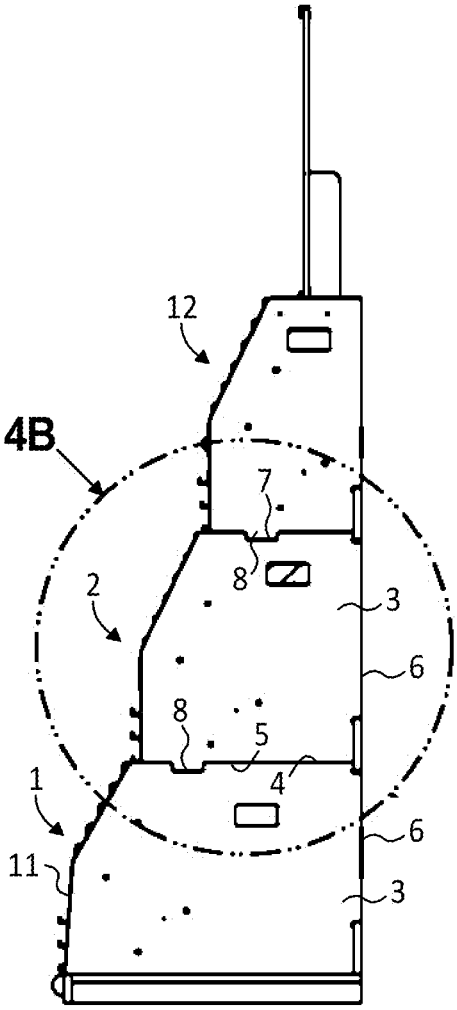
FIG. 4A illustrates a side view of three assembled compartments.
Figure 4B:
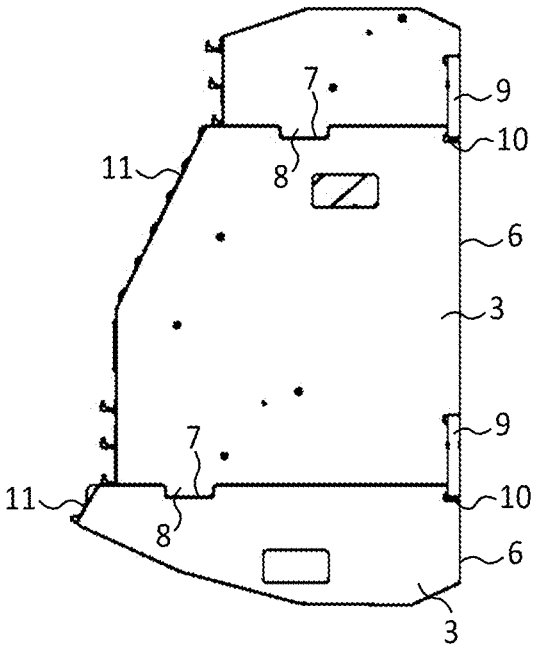
FIG. 4B illustrates a local side view of three assembled compartments.

As illustrated in FIGS. 3, 4A and 4B for example, the length of the bottom surface 3 of the first compartment 1 is greater than the length of the bottom surface 3 of the second compartment 2. In addition, the length of the top surface 4 of the first compartment 1 is greater than the length of the top surface 4 of the second compartment 2. These differences in length contribute to a display unit wherein the face of the second compartment 2 is angled or set back with respect to the face of the first compartment 1 so that the display unit can display many materials in a tiered manner and to enhance access to items displayed.

As illustrated in FIGS. 1, 4A and 4B for example, the sidewall 3 of the first compartment 1 comprises a front surface 11 and a top surface 4. The corner formed by the front surface 11 and top the surface 4 may be truncated as may be the corner formed by the front surface 11 and top surface 4 of other compartments, such as compartments 2 and 12. These configurations contribute to a display having an angled or set back arrangement which can display many materials in a tiered manner.

Figure 8:
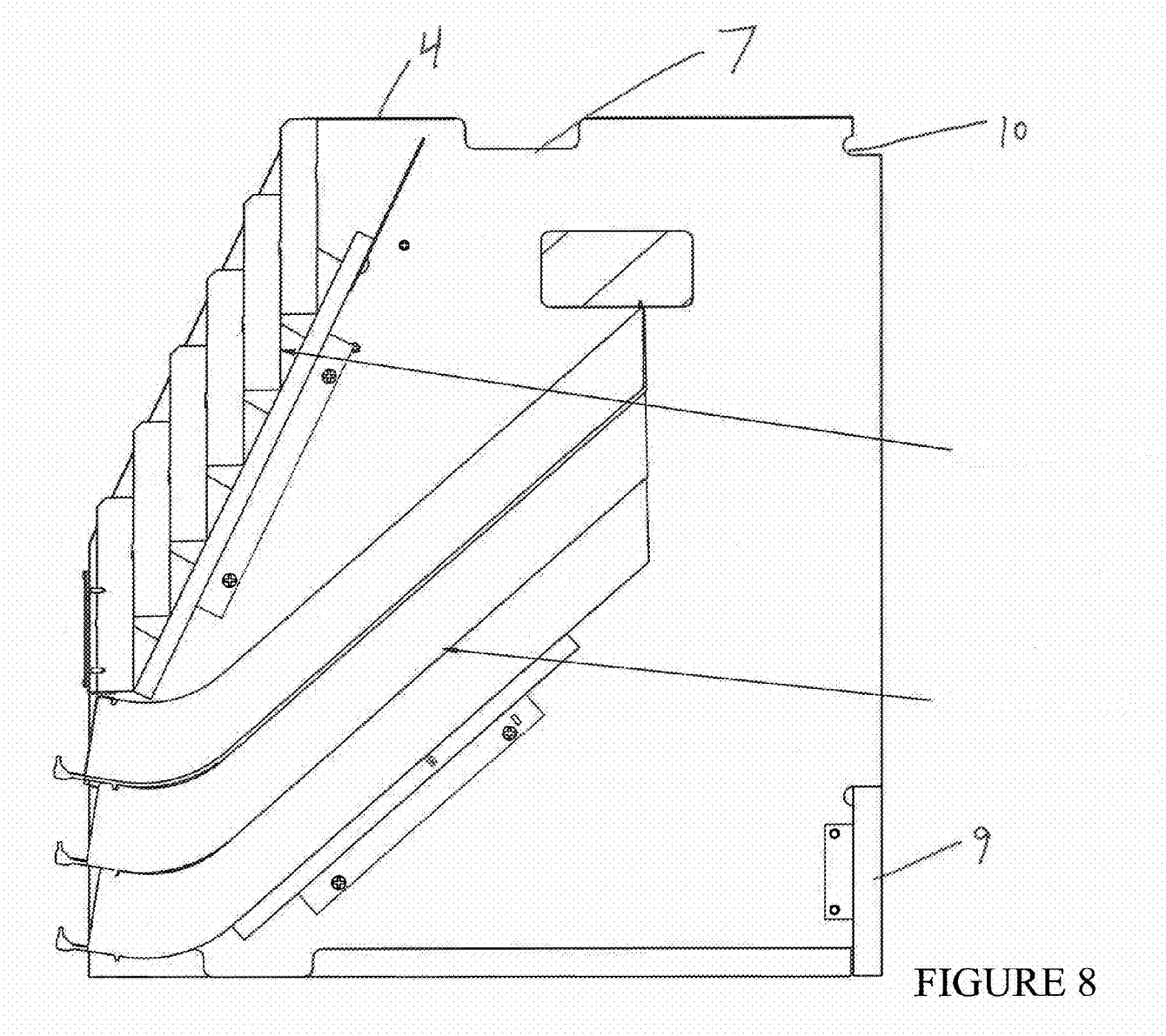
FIG. 8 illustrates a cut away side view of a compartment.

In some embodiments as illustrated in FIGS. 4A, 4B and 8 for example, the groove 7 of the first compartment 1 is located approximately one-fourth of the distance along the top surface 4 of the first compartment 1. As illustrated in FIGS. 4A and 4B for example, the tongue 8 of the second compartment 2 is located approximately one-fourth of the distance along the bottom surface 5 of the second compartment 2. The locations of the groove 7 and the tongue 8 help stabilize the assembled compartments. The locations of the groove 7 and the tongue 8 can be modified to stabilize the assembled compartments in any manner known to those in the art.

Figure 5:
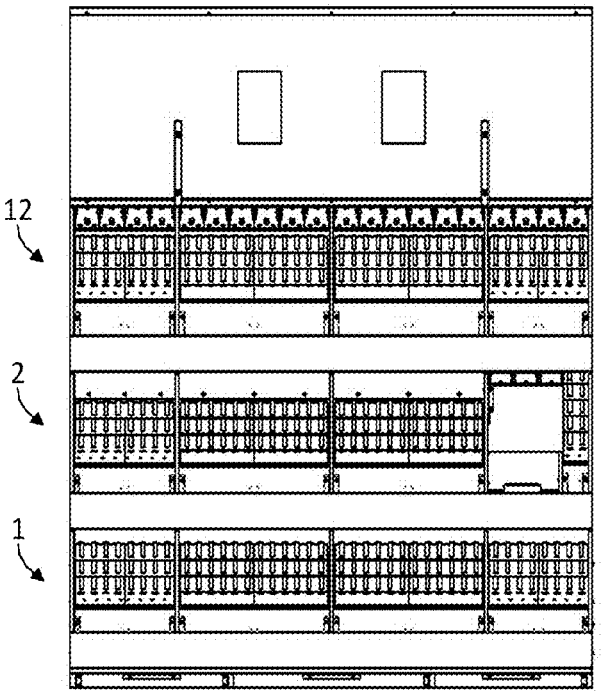
FIG. 5 illustrates a back view of three rows of assembled compartments.
Figure 6:
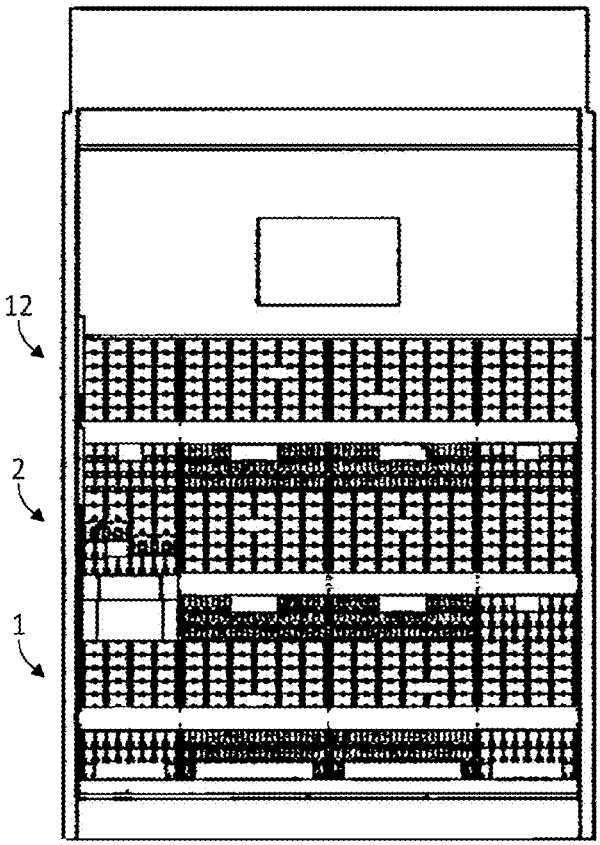
FIG. 6 illustrates a front view of three rows of assembled compartments.
Figure 7:
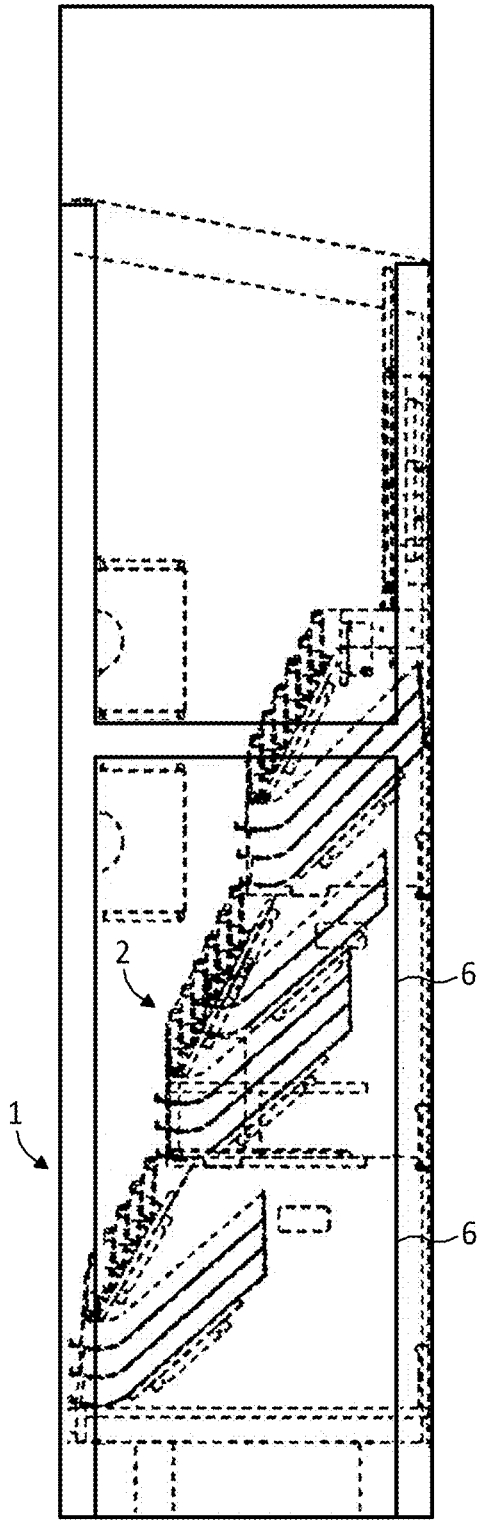
FIG. 7 illustrates a side view of three assembled compartments behind a side support panel.

As illustrated in FIGS. 5, 6 and 7, the plurality of interlocking compartments may comprise a third compartment 12. In some embodiments, the plurality of interlocking compartments comprise between about 2 to about 10 compartments. However, any number of compartments can be employed in the present invention.

FIGS. 1, 4A and 4B illustrate the top surface 4 of the second compartment 2 having a groove 7 for receiving a tongue 8 of a bottom surface 5 of the third compartment 12. The rear surface 6 of the third compartment 12 comprises a projection 9. The rear surface 6 of the third compartment 12 and the top surface 4 of the second compartment 2 form a corner having an indentation 10 for receiving the projection 9. The third compartment 12 can be securely affixed to the second compartment 2 by mating tongue 8 with groove 7. The third compartment 12 can also be securely affixed to the second compartment 2 by mating projection 9 with indentation 10. In a similar manner to the connection of the third compartment 12 to the second compartment 2, fourth, fifth, sixth or any number of additional compartments can be affixed in this manner.

In some embodiments as illustrated in FIGS. 1 and 7 for example, the rear surface 6 of the first compartment 1 and the rear surface 6 of the second compartment 2 are substantially planar. As a result, the interlocking compartments can be placed adjacent a wall.

In some embodiments of the invention as illustrated in FIG. 1 for example, the plurality of interlocking compartments comprise a first compartment 1 having a vertical sidewall 3 comprising a top surface 4, a bottom surface 5 and a rear surface 6. A second compartment 2 having a vertical sidewall 3 comprising a top surface 4, a bottom surface 5 and a rear surface 6 is also present. In addition, a third compartment 12 having a vertical sidewall 3 comprising a bottom surface 5 and a rear surface 6 is provided. The second compartment 2 is disposed on the top surface 4 of the first compartment 1 and the third compartment 12 is disposed on the top surface 4 of the second compartment 2.

In some embodiments, the length of the bottom surface 5 of the first compartment 1 is greater than the length of the bottom surface 5 of the second compartment 2, and the length of the bottom surface 5 of the second compartment 2 is greater than the length of the bottom surface 5 of the third compartment 12. These differences in length contribute to a display unit wherein the face of the second compartment 2 is angled or set back with respect to the face of the first compartment 1 so that the display unit can display many materials in a tiered manner.

As shown in FIGS. 1, 4A and 4B for example, the top surface 4 of the first compartment 1 comprises a groove 7 for receiving a tongue 8 of the bottom surface 5 of the second compartment 2. The second compartment 2 can be securely affixed to the first compartment 1 by mating tongue 8 with groove 7.

The rear surface 6 of the second compartment 2 comprises a projection 9. The rear surface 6 of the first compartment 1 and the top surface 4 of the first compartment 1 form a corner having an indentation 10 for receiving the projection 9. The second compartment 2 can also be securely affixed to the first compartment 1 by mating projection 9 with indentation 10. In a similar manner to the connection of the second compartment 2 to the first compartment 1, third, fourth, fifth, sixth or any number of additional compartments can be affixed in this manner.

FIGS. 1, 4A and 4B illustrate an embodiment wherein the sidewall 3 of the first compartment 1 comprises a front surface 11, and wherein the corner formed by the front sidewall 11 and the top surface 4 is truncated. The sidewall 3 of the second compartment 2 also comprises a front surface 11, and wherein the corner formed by the front sidewall 11 and the top surface 4 is truncated. Still further, the sidewall 3 of the third compartment 12 comprises a front surface 11, and wherein the corner formed by the front sidewall 11 and the top surface 4 is truncated. These truncated corners contribute to a display unit wherein the faces of the first, second and third compartment 1,2, 12 are angled or set back so that the display unit can display many materials in a tiered manner and enhance access to items displayed.

As illustrated in FIGS. 1, 5 and 8, the rear surface 6 of the first compartment 1, the rear surface 6 of the second compartment 2, and the rear surface 6 of the third compartment 12 may be substantially planar. As a result, the interlocking compartments can be placed adjacent a wall.

The interlocking compartments of the present invention may be assembled to form a display unit for shelving, storing or displaying any type of merchandise or boxed items.

What is claimed is:

1. A plurality of interlocking compartments for a display unit, comprising:

a first compartment and a second compartment each having a vertical sidewall comprising a top surface, a bottom surface and a rear surface, wherein at least one of the first and second compartments comprises a front face angled backward from the bottom to the top of the at least one first or second compartment, the front face comprising tiered shelving structured and arranged to display paint chips, wherein the bottom surface of the second compartment comprises a tongue and the rear surface of the second compartment comprises a projection, wherein the top surface of the first compartment comprises a groove for receiving the tongue of the bottom surface of the second compartment, and wherein the rear surface of the first compartment and the top surface of the first compartment form an indentation at an intersection of the rear and top surfaces of the first compartment that extends horizontally inward from the rear surface of the first compartment and extends vertically downward from the top surface of the first compartment for receiving the projection.

2. The interlocking compartments of claim 1, wherein the length of the bottom surface of the first compartment is greater than the length of the bottom surface of the second compartment.

3. The interlocking compartments of claim 1, wherein the length of the top surface of the first compartment is greater than the length of the top surface of the second compartment.

4. The interlocking compartments of claim 1, wherein the sidewall of the first compartment comprises a front surface and a top surface, wherein at least the corner formed by the front surface and the top surface is truncated.

5. The interlocking compartments of claim 1, wherein the groove of the first compartment is located approximately one-fourth of the distance along the top surface of the first compartment.

6. The interlocking compartments of claim 1, wherein the tongue of the second compartment is located approximately one-fourth of the distance along the bottom surface of the second compartment.

7. The interlocking compartments of claim 1, further comprising a third compartment.

8. The interlocking compartments of claim 7, wherein a top surface of the second compartment comprises a groove for receiving a tongue of a bottom surface of the third compartment.

9. The interlocking compartments of claim 8, wherein a rear surface of the third compartment comprises a projection.

10. The interlocking compartments of claim 9, wherein the rear surface of the second compartment and the top surface of the second compartment form an indentation at an intersection of the rear and top surfaces of the second compartment that extends horizontally inward from the rear surface of the second compartment and extends vertically downward from the top surface of the second compartment for receiving the projection of the rear surface of the third compartment.

11. The interlocking compartments of claim 1, wherein the rear surface of the first compartment and the rear surface of the second compartment are substantially planar.

12. A plurality of interlocking compartments for a display unit, comprising:

a) a first compartment having a vertical sidewall comprising a top surface, a bottom surface and a rear surface;

b) a second compartment having a vertical sidewall comprising a top surface, a bottom surface and a rear surface; and c) a third compartment having a vertical sidewall comprising a bottom surface and a rear surface;

wherein the second compartment is disposed on the top surface of the first compartment and the third compartment is disposed on the top surface of the second compartment, and wherein at least one of the first, second and third compartments comprises a front face angled backward from the bottom to the top of the at least one first, second or third compartment, the front face comprising tiered shelving structured and arranged to display paint chips, wherein the length of the bottom surface of the first compartment is greater than the length of the bottom surface of the second compartment, and the length of the bottom surface of the second compartment is greater than the length of the bottom surface of the third compartment, wherein the rear surface of the second compartment comprises a projection, and wherein the rear surface of the first compartment and the top surface of the first compartment form an indentation at an intersection of the rear and top surfaces of the first compartment that extends horizontally inward from the rear surface of the first compartment and extends vertically downward from the top surface of the first compartment for receiving the projection.

13. The interlocking compartments of claim 12, wherein the top surface of the first compartment comprises a groove for receiving a tongue of the bottom surface of the second compartment.

14. The interlocking compartments of claim 12, wherein the sidewall of the first compartment comprises a front surface, and wherein at least a portion of the front surface forms an acute angle with the rear surface of the first compartment.

15. The interlocking compartments of claim 12, wherein the sidewall of the second compartment comprises a front surface and a top surface, wherein at least the corner formed by the front surface and the top surface is truncated.

16. The interlocking compartments of claim 12, wherein the sidewall of the third compartment comprises a front surface and a top surface, wherein at least the corner formed by the front surface and the top surface is truncated.

17. The interlocking compartments of claim 12, wherein the rear surface of the first compartment, the rear surface of the second compartment, and the rear surface of the third compartment are substantially planar.

18. The interlocking compartments of claim 1, wherein the groove extends through an entire thickness of the vertical sidewall of the first compartment.

19. The interlocking compartments of claim 1, wherein the tongue comprises a planar outer wall and a planar inner wall, and has a thickness measured between the planar outer and inner walls that is equal to a thickness of the vertical sidewall of the second compartment.

20. The interlocking compartments of claim 12, wherein the groove extends through an entire thickness of the vertical sidewall of the first compartment.

21. The interlocking compartments of claim 12, wherein the tongue comprises a planar outer wall and a planar inner wall, and has a thickness measured between the planar outer and inner walls that is equal to a thickness of the vertical sidewall of the second compartment.

* * * * *